United States Patent [19]

Morrill

[11] Patent Number: 5,070,678

[45] Date of Patent: Dec. 10, 1991

[54] CHRISTMAS TREE MOVING AND BAGGING CART

[76] Inventor: Paul M. Morrill, 10716 SW. 63rd Pl., Portland, Oreg. 97219

[21] Appl. No.: 596,714

[22] Filed: Oct. 10, 1990

[51] Int. Cl.[5] ..... B65B 5/04; B65B 67/00

[52] U.S. Cl. ..... 53/459; 53/469; 53/390; 53/255; 414/490

[58] Field of Search ..... 53/241, 255, 390, 392, 53/459, 469; 47/20, 21; 280/47.24; 414/23, 453, 454, 490

[56] References Cited

U.S. PATENT DOCUMENTS

| | | | |
|---|---|---|---|
| 2,234,433 | 3/1941 | Jeffrey | 414/23 |
| 2,242,695 | 5/1941 | Copeen | 414/23 |
| 4,257,729 | 3/1981 | Morissette | 414/454 X |
| 4,917,393 | 4/1917 | Rogers | 53/390 X |

*Primary Examiner*—John Sipos
*Assistant Examiner*—Linda B. Johnson
*Attorney, Agent, or Firm*—Eugene M. Eckelman

[57] ABSTRACT

An upright frame member has an upper handle and bottom support wheels. A forwardly projecting boom is secured to the upright frame and is of a length at least as long as tree branches of a tree to be mounted on the cart. A clamp is carried on the forward end of the boom capable of removably clamping a tree at the lower end of the trunk to the boom and supporting the tree on the cart in parallel relation with the upright frame. The upright frame and the boom are disposed relative to each other such that when the cart is laid down rearwardly the center of gravity of the cart and tree is offcenter toward the handle whereby the cart will rest upsupported in such laid down position and suspend the tree horizontally for bagging. A hook is provided on the upright frame for holding a bag in telescoped relation on the boom prior to use. In the method of bagging a tree, an open ended bag is first pulled in telescoping relation over the boom and attached to the hook on the upright frame. Thereupon a tree is clamped in position on the cart parallel with the upright frame. Thereupon the cart is laid down backwards and the bag pulled off of the boom and onto the tree. In a final step, the ends of the bag are tied.

10 Claims, 2 Drawing Sheets

12
T
23
32
18
30
34
22
24
28
26
41
42
10b
38
40
36
B
10
10a
16
14
T
23
22
32
30
34
24
18
28
26

CHRISTMAS TREE MOVING AND BAGGING CART

BACKGROUND OF THE INVENTION

This invention relates to a handcart and more particularly is concerned with a cart adapted for attachment to a Christmas tree and also adapted to move the tree from place to place and support the tree for bagging.

Christmas tree flocking has become greatly popularized for beautifying the trees but the handling of such trees during and/or after flocking amounts to a considerable problem. That is, the flocking is easily knocked off or otherwise damaged whereby any appreciable contact therewith will ruin the appearance of the tree. It is customary to bag the trees after they are flocked to protect them and to contain excess flocking material that may fall off. Carts are available that employ a boom with a front fork which is pushed through the branches on the tree and hooked onto trunk portions of the tree. This type of cart has the disadvantage that it is difficult to thread the lifting fork into and out of the branches without damaging the flocking. Also, a cart is available that has a boom capable of reaching under the branches at the bottom of the tree and providing a clamped tree lifting engagement. This type of cart is useful only for moving the tree but is not used for bagging.

SUMMARY OF THE INVENTION

It is an object of the present invention to provide a Christmas tree moving and bagging cart that can be used to efficiently wheel the tree from place to place and due to its particular structure can be used to bag the tree in a novel method.

In carrying out the objectives of the invention, the cart includes an upright frame member having an upper handle portion and a lower wheeled portion. A boom projects forwardly from the lower wheeled portion and is of a length at least as long as tree branches. The forward end of the boom has a clamp capable of removably clamping the tree to the cart in a position which is substantially parallel with the upright frame member. The upright frame member and the boom are arranged such that when the cart is laid down rearwardly with the upright frame member substantially parallel with the floor and with a tree clamped on the boom, the combined center of gravity of the cart and tree is off-center toward the upper handle portion whereby the cart will rest in its laid down position and suspend the tree substantially horizontally for bagging. The upright frame member has a bagging tube hook for holding an open ended bag on the boom prior to and at the time a tree is being mounted on the boom. For the purpose of bagging a tree, the open ended tube is first placed telescopically over the boom and hooked if desired to the hook on the upright frame member. A tree is then clamped to the boom in parallel relation with the upright frame member and then the cart is laid down backwards for suspending the tree horizontally. Thereupon, the tube is pulled off of the boom and onto the tree and tied. The bagged tree can then be removed from the cart.

The invention will be better understood and additional objects and advantages will become apparent from the following description taken in connection with the accompanying drawings.

DETAILED DESCRIPTION OF A PREFERRED EMBODIMENT

Figures 1, 2:
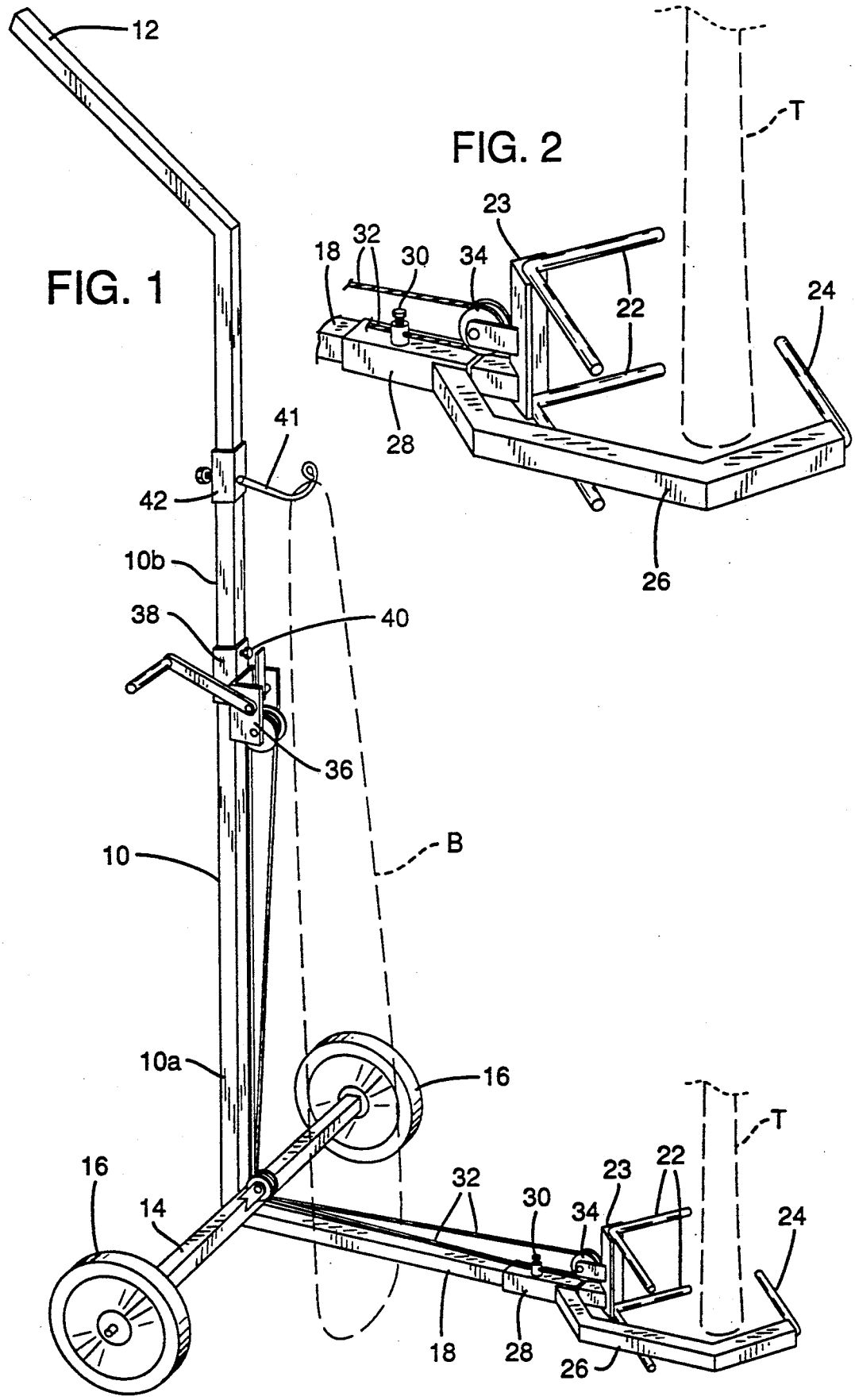
FIG. 1 is a perspective view of the cart of the invention.
FIG. 2 is a fragmentary perspective view of the bottom tree clamping portion of the cart.

With reference first to FIGS. 1 and 2, the present Christmas tree moving and bagging cart has an upright frame member 10 terminating at the upper end in a rearwardly turned upwardly angled handle portion 12. Frame member 10 is supported on an axle 14 with opposite wheels 16. An elongated cantileverlike boom member 18 projects forwardly from a central portion of the axle housing and is of a length equal to or slightly greater than the length of bottom branches of a Christmas tree T. This boom member extends at substantially right angles forwardly from the upright frame member 10.

The front of the boom has forwardly open socket-like jaw members 22 mounted in vertically spaced relation from each other on an upright right member 23 integral with the boom. An opposing jaw member 24 is mounted on the end of an arm 26 that is contoured outwardly at one side and open at the other side. This arm is mounted on a sleeve 28 slidably supported on the boom 18. Sleeve 28 is connected, by a connector 30,to a cable 32 operating over pulleys 34 and forming with such pulleys link means for a double acting winch mechanism 36 secured to an upper portion of the upright frame member 10 for easy access to the operator. By suitable operation of the winch, the jaw 24 can be moved into and out of clamping engagement with a tree trunk T. The winch 36 is supported on a collar 38 that provides a bolted connection 40 between a lower main frame portion **10*a* and an upper frame portion 10*b* that terminates in the handle 12**.

A laterally extending hook 41 is supported on an upper portion of the upright frame member 10 on which an open-ended bagging tube B can be hooked, as will be more apparent hereinafter. This hook is supported on a sleeve 42 slidably mounted on the upright frame portion **10*b*** and having adjustable height clamped engagement therewith by a suitable set screw.

In the use of the present cart, it can be used to transport trees in upright relation by clamping a lower trunk portion of the tree in the jaw members 22 and 24. This tree movement can be accomplished without damaging any decorating means, such as flocking on the trees.

Figure 3:
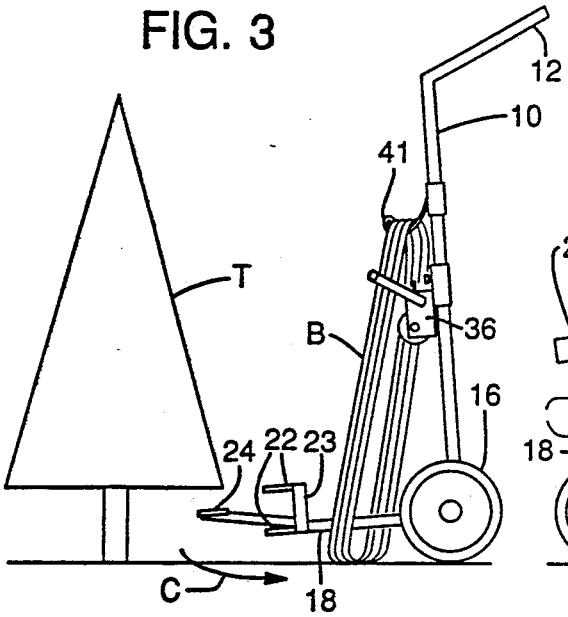
FIGS. 3–7 are diagrammatic views showing steps in the process of bagging a tree.

The present invention finds usefulness not only in moving trees place to place but also in bagging flocked trees. For this purpose, and with reference first to FIG. 3, an appropriate size open ended bagging tube B is moved telescopically over the end of the boom 18, as designated by the arrow C. The end of the tube adjacent the upright frame member 10 can be hooked on the hook 38 to support the tube in a ready position. The bag that is used will be of a selected diameter capable of covering the tree to be flocked. With the tube supported on the cart, the cart is then moved forward to obtain clamping engagement with a flocked tree, such clamping engagement being accomplished adjacent the bottom of the tree trunk without danger of damaging the flocking material. Clamping the tree in upright relation by means of the vertically spaced jaws 22 in cooperation with jaw 24 will cause the tree to be attached and held on the cart in substantially parallel relation with the upright frame member 10.

Figure 4:
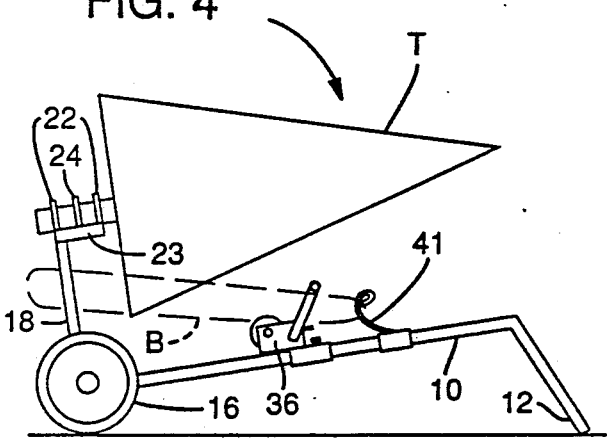
Figure 5:
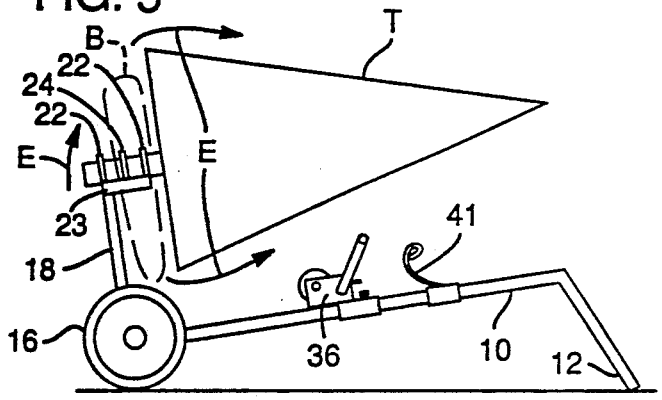
Figure 6:
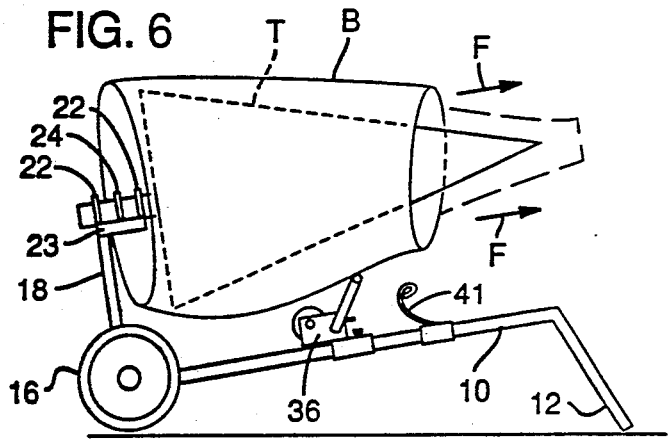
Figure 7:
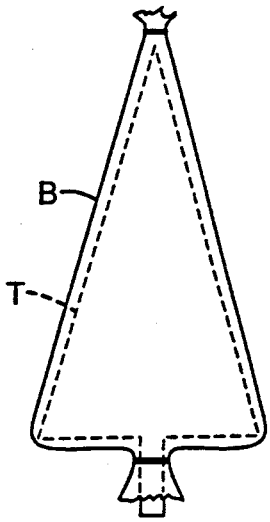

Thereupon, the cart is laid down backwards, as designated by the arrow D, FIG. 4, to rest the handle 12 on the floor whereby the tree will assume almost a horizontal position and the handle 12 serves as a foot. The tube B is then unhooked from the hook 41, FIG. 5, and pulled off the boom and up over the tree, as designated by the arrows E in FIG. 5 and arrows F in FIG. 6. The right angle disposition of the boom with relation to the upright support member 10 causes the center of gravity of the cart and the tree to be rear of the wheels whereby such center of gravity will maintain the cart in its rearward laid down postion for convenience of the operator in bringing the tube up over the tree. After the tree is bagged, the ends of the tube are tied, FIG. 7, and the bag is ready for shipment.

According to the invention, the cart provides a convenient way of handling trees, particularly flocked trees. As noted, the cart also is particularly adaptable for bagging trees, namely, with its particular structure supporting a tree and allowing the cart and the tree to be tipped rearwardly to a laid down position.

The flocked portion of a flocked tree thus does not need to be disturbed whatsoever in handling the trees as well as in bagging it. The handle portion **10*b* can be removed from the collar 38 for packaging and also this portion can be inverted in use wherein the handle 12 will comprise an extension of the main frame member 10 and the portion 10*b*** will then be the handle. Such reversal of the upper portion of the frame is done to vary the height of the handle.

It is to be understood that the form of my invention herein shown and described is to be taken as a preferred example of the same and that various changes in the shape, size and arrangment of parts may be resorted to without departing from the spirit of my invention, or the scope of the subjoined claims.

Having thus described my invention, I claim:

1. A Christmas tree moving and bagging cart comprising:

an upright frame member having an upper handle portion and a wheeled lower portion, a forwardly projecting cantilever-type boom on said lower wheeled portion for receiving an open ended bagging tube in telescoping relation, said boom being of a length between forward and rearward ends thereof at least as long as tree branches of a tree to be mounted on the cart, and clamp means on the forward end of said boom capable of removably clamping a tree trunk at the lower end thereof such that the tree is mounted on the cart in a position substantially parallel with said upright frame member, said upright frame member and said boom being arranged such that when the cart is laid down rearwardly with the upright frame member substantially parallel with the floor and with the tree clamped on the boom, the combined center of gravity of the cart and tree is off-center toward said upper handle portion whereby the cart will rest in said laid down position and suspend the tree substantially horizontally to allow the bagging tube to be pulled over a tree secured in said clamping means.

2. The Christmas tree and bagging cart of claim 1 wherein said boom extends substantially at right angles to said upright frame member.

3. The Christmas tree moving and bagging cart of claim 1 including a hook on an upper portion of said upright frame member arranged to temporarily hold the open end bagging tube in telescoped relation on said boom on the cart and also arranged to release the bagging tube whereby the latter can be subsequently pulled off said boom and over a tree on the cart.

4. The Christmas tree moving and bagging cart of claim 3 wherein said hook is adjustably mounted on said upright frame member to accommodate bagging tubes of different diameters.

5. The Christmas tree moving and bagging cart of claim 3 wherein said hook extends out laterally from said upright frame member.

6. The Christmas tree moving and bagging cart of claim 1 wherein said handle portion comprises a rearward extension that serves as a foot at said upper handle portion when the cart is laid down rearwardly.

7. The Christmas tree moving and bagging cart of claim 1 wherein said clamp means comprises a first jaw member mounted integrally on the forward end of said boom, a second jaw member slidably supported on said boom in opposing relation to said first jaw member, and winch drive means connected to said second jaw member for moving said second jaw member into and out of clamping engagement with a tree trunk.

8. The Christmas tree moving and bagging cart of claim 7 wherein said winch drive means comprises a winch drum on said upright frame member and cable and pulley means connected to said second jaw member.

9. A method of bagging a Christmas tree by using a wheeled cart having an upright frame member and a lowered forwardly projecting horizontal tree clamping boom extending substantially at right angles to the upright frame member, comprising the steps of:

pulling an open ended tube in telescoping relation over said boom beyond the forward end thereof, clamping a Christmas tree to the forward end of the boom with the trunk of the tree extending substantially parallel with the upright frame member, laying the cart down backwards with the boom extending upwardly whereby the tree will be disposed substantially horizontally, and then pulling the open ended tube off the boom and onto the tree.

10. The process of claim 9 including a final step of closing opposite ends of the tube to seal the tree in bagging relation.

* * * * *